US008776471B2

(12) United States Patent
Jenkins et al.

(10) Patent No.: US 8,776,471 B2
(45) Date of Patent: Jul. 15, 2014

(54) LAMINATED ROOFING SHINGLE WITH CONTRAST ZONES PROVIDING VARIEGATED APPEARANCE

(71) Applicants: Robert L. Jenkins, HoneyBrook, PA (US); Gregory F. Jacobs, Oreland, PA (US)

(72) Inventors: Robert L. Jenkins, HoneyBrook, PA (US); Gregory F. Jacobs, Oreland, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 13/940,365

(22) Filed: Jul. 12, 2013

(65) Prior Publication Data

US 2013/0298490 A1 Nov. 14, 2013

Related U.S. Application Data

(63) Continuation of application No. 13/198,813, filed on Aug. 5, 2011.

(60) Provisional application No. 61/512,125, filed on Jul. 27, 2011.

(51) Int. Cl.
*E04D 1/00* (2006.01)

(52) U.S. Cl.
USPC ..... 52/555; 52/314; 52/557; 428/141

(58) Field of Classification Search
USPC ..... 52/311.1, 314, 554, 555, 557; 428/141, 428/143–145
See application file for complete search history.

(56) References Cited

U.S. PATENT DOCUMENTS

| | | | | | |
|---|---|---|---|---|---|
| 5,369,929 | A * | 12/1994 | Weaver et al. | ..... | 52/557 |
| 5,611,186 | A * | 3/1997 | Weaver | ..... | 52/557 |
| 5,666,776 | A * | 9/1997 | Weaver et al. | ..... | 52/557 |
| 6,014,847 | A * | 1/2000 | Phillips | ..... | 52/311.1 |
| 6,190,754 | B1 * | 2/2001 | Bondoc et al. | ..... | 428/143 |
| 6,289,648 | B1 * | 9/2001 | Freshwater et al. | ..... | 52/557 |
| 6,708,456 | B2 * | 3/2004 | Kiik et al. | ..... | 52/98 |
| 6,933,037 | B2 * | 8/2005 | McCumber et al. | ..... | 428/143 |
| 6,990,779 | B2 * | 1/2006 | Kiik et al. | ..... | 52/554 |
| 7,240,462 | B2 * | 7/2007 | Elliott et al. | ..... | 52/557 |
| 2003/0093963 | A1 * | 5/2003 | Stahl et al. | ..... | 52/555 |
| 2003/0163964 | A1 * | 9/2003 | Elliott | ..... | 52/314 |
| 2004/0123537 | A1 * | 7/2004 | Elliott et al. | ..... | 52/314 |
| 2005/0193673 | A1 * | 9/2005 | Rodrigues et al. | ..... | 52/518 |

* cited by examiner

*Primary Examiner* — Brian Glessner
*Assistant Examiner* — Brian D Mattei
(74) *Attorney, Agent, or Firm* — Paul & Paul

(57) ABSTRACT

A laminated roofing shingle is provided, having an anterior shingle layer and a posterior shingle layer. Openings exist in tab portions of the anterior shingle layer, allowing for visible front surface portions of the posterior shingle layer to be visible through the openings. Such visible portions can be of varying vertical contrast from at least some of the top edges of the openings to at least some of the bottom edges of the posterior shingle layer that are exposed through the openings, and are generally of consistent horizontal contrast between right and left edges of the openings. Front surface portions of the posterior shingle layer that are exposed through one or more openings have a different contrast that is in interrupting contrast to at least a portion of any of the varying or consistent contrast that are visible through the openings between tabs of the anterior shingle layer.

25 Claims, 2 Drawing Sheets

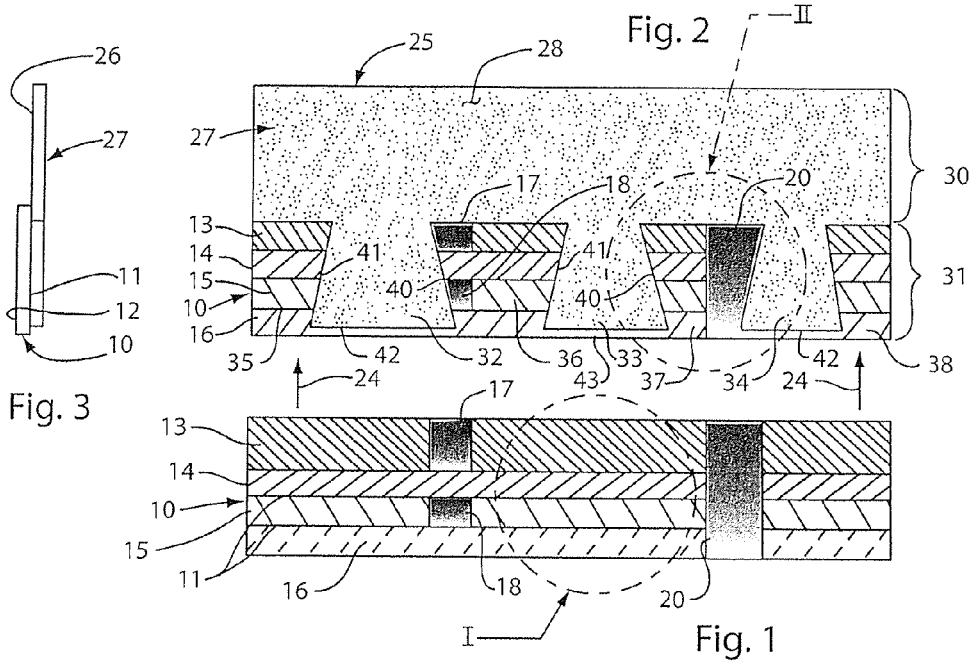
Fig. 2
Fig. 3
Fig. 1
25
26
27
28
30
31
II
I
10
11
12
13
14
15
16
17
18
20
24
32
33
34
35
36
37
38
40
41
42
43
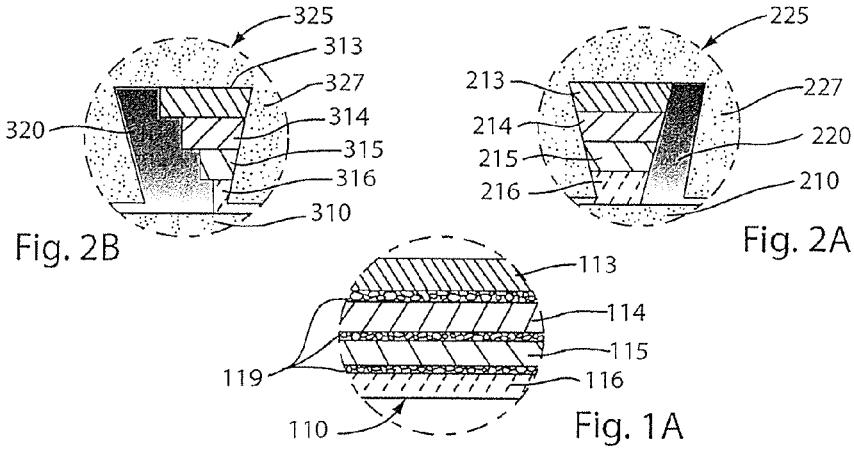
Fig. 2B
Fig. 2A
Fig. 1A
325
313
327
314
315
316
310
320
225
213
214
215
216
227
220
210
113
114
115
116
119
110

LAMINATED ROOFING SHINGLE WITH CONTRAST ZONES PROVIDING VARIEGATED APPEARANCE

CROSS-REFERENCE TO RELATED APPLICATIONS

This application is a continuation of U.S. application 13/198,813 filed Aug. 5, 2011, which, in turn, claims priority from provisional application 61/512,125 filed Jul. 27, 2011, the complete disclosures of which are herein incorporated by reference.

BACKGROUND OF THE INVENTION

The present invention is directed to a multi-layer shingle, preferably one constructed of asphaltic roofing material and most particularly one having an asphaltic material provided over a base mat which then has granules applied to surfaces thereof.

The art of shingle manufacture is highly developed, and improvements in shingle manufacturing have been subtle, often being devoted to the simulation of wood, slate, tile or other natural appearing materials.

In the course of shingle development, some approaches have been made toward applying granules of various color, shading, tone and combinations thereof.

Some of these developments have involved providing a multi-layer shingle, of at least two layers, one being an anterior shingle layer and another being a posterior shingle layer. Sometimes, portions of the shingle that are adapted to be exposed to the environment when laid up on a roof have been provided with different areas of shading, at different depths or planes, whereby the visual contrast, upon viewing a roof comprised of such shingles from the front, is to provide to the appearance of increased depth, or thickness of the shingle.

Sometimes this increased depth or thickness is achieved by having darker portions of an underlying or posterior layer of shingle visible between or beneath adjacent tabs of the shingle. An example of this is in U.S. Pat. No. 6,523,316, the complete disclosure of which is herein incorporated by reference.

Another example of achieving different aesthetic effects that produce, in a manufactured shingle, the appearance of changes in texture, color or combinations thereof, are set forth in U.S. Pat. No. 4,352,837, the complete disclosure of which is also herein incorporated by reference. Another example of a shingle wherein different granule applications are provided in order to achieve various aesthetics effects is set forth in U.S. Pat. No. 5,181,361, the complete disclosure of which is also herein incorporated by reference.

Other laminated shingles wherein different color and contrast effects are achieved for laminated shingles having openings between adjacent tabs of the anterior shingle layer and with a backing or posterior shingle layer exist in U.S. Pat. Nos. 4,900,589; 4,717,614; 6,289,648; 6,190,754; Des 344, 144; 5,369,929; 5,611,186 and 5,666,776, the complete disclosures of which are herein incorporated by reference. Some of these shingles, because of the opening configurations between adjacent tabs, are also referred to as "dragon's tooth" shingles.

SUMMARY OF THE INVENTION

A laminated roofing shingle is provided having an anterior shingle layer with a headlap and a tab portion, with the tab portion having a plurality of tabs separated by openings. The posterior shingle layer is adhered to the rear surface of the anterior shingle layer, with portions of the posterior shingle layer being visible through the openings between tabs of the anterior shingle layer.

In those openings, there is a varying vertical contrast from top to bottom, and a generally consistent horizontal contrast. A portion of the posterior shingle layer that is exposed through one or more openings between the tabs has a different contrast that interrupts a portion of the varying or consistent contrast.

The varying vertical contrast can be in the form of a plurality of horizontally extending but different vertical striations, or the vertical contrast can be a vertically gradual variation. The contrast that interrupts the striations or vertical gradual variations can be lighter or darker, relative to other portions of the posterior shingle layer that is visible through the openings, or can take on various forms.

Accordingly, it is a primary object of this invention to provide a laminated roofing shingle having anterior and posterior shingle layers, with openings between spaced-apart tabs of the anterior shingle layer, by which portions of the front surface of the posterior shingle layer are visible, and but the posterior shingle layer having vertical contrast that is interrupted by a different contrast.

It is another object of this invention to encompass the above object, wherein the tabs and openings are in the form of "dragon's teeth".

The vertically varying contrast may be in the form of a plurality of separate zones or striations, or a vertically gradual variation, in each case the varying contrast being a variation in tones of the same color, or of different colors or blends of colors or tones, or vertical variation in darkness or lightness.

It is another object of this invention to accomplish the above objects, wherein the interruption by a different contrast can be a lighter or darker variation of some of the same colors, or different colors, or tones or blends of colors or tones, in one or more openings between adjacent tabs.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

FIG. 1 is a front elevational view of a shim or posterior shingle layer, adapted for adhesive disposition behind an anterior or top shingle layer of a laminated roofing shingle.

FIG. 1A is a detail view of a modified portion of FIG. 1, taken generally from zone I of FIG. 1, with separation areas between the striations of FIG. 1.

FIG. 2 is a top illustration of a dragon's tooth type shingle in accordance with this invention, comprised of a posterior layer of the FIG. 1 type and an anterior shingle layer, with various striations of the posterior layer showing through openings between adjacent tabs, which striations are generally consistent in contrast horizontally, but which vary in contrast vertically, and wherein such striations are shown as being interrupted by areas of different contrast in some of the openings.

FIG. 2A is a modified form of the zone II of FIG. 2, wherein the striations are shown as being interrupted by a modified area of different contrast.

FIG. 2B is a modified form of the zone II of FIG. 2, wherein the striations are shown as being interrupted by a modified area of yet another different contrast.

FIG. 3 is a left elevational view of the shingle of FIG. 2.

Figure 4:
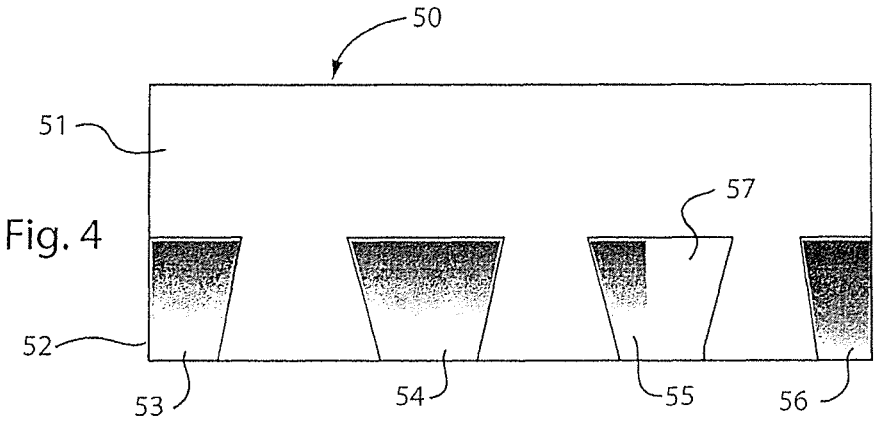

FIG. 4 is a front plan view of a shingle in accordance with this invention, wherein the visible portions of the front surface of the posterior shingle layer are illustrated as having vertically gradual variation in tone from top to bottom, and wherein one of the openings has a different, interrupting contrast, that is lighter in appearance.

Figure 5:
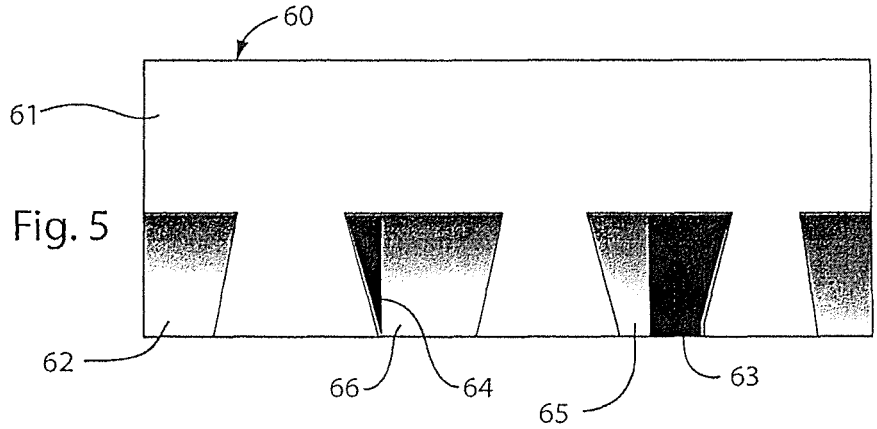

FIG. 5 is an illustration like that of FIG. 4, but wherein the area of interrupting different contrast is darker, and appears in portions of two of the openings between tabs.

Figure 6:
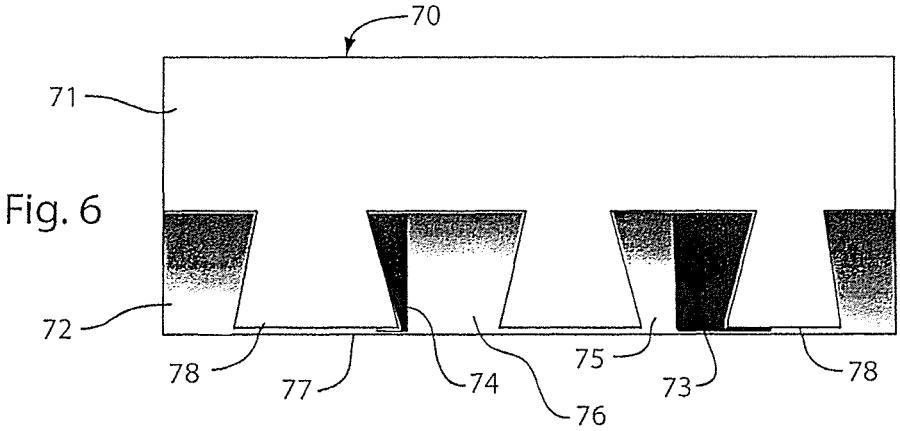

FIG. 6 is an illustration like that of FIG. 5, but wherein the posterior shingle layer extends slightly lower than the lower edges of the tabs of the anterior shingle layer.

DETAILED DESCRIPTIONS OF THE PREFERRED EMBODIMENTS

Referring now to the drawings in detail, reference is first made to FIG. 1, wherein a posterior layer of shingle material is generally designated by the numeral 10. This posterior layer can also be referred to as a shim layer.

The posterior layer has a front surface 11 and a rear surface 12. The front surface 11 has a plurality of generally horizontal striations 13-16 that vary in vertical contrast, preferably with the striation 13 being the darkest, the layer 14 being somewhat lighter, the striation 15 being somewhat lighter than the striation 14, and the striation 16 being the lightest. The cross hatchings shown in the various striations 13-16 are used as a drafting expedient to show contrast that varies from darker to lighter as one goes from striation 13 to striation 16. Generally, within each of the striations 13-16, the contrast is horizontally the same, or generally consistent horizontally.

There are zones of different contrast, comprising zones 17, 18 and 20, which can be zones of darker contrast than any of the striations 13-16, although, it will be understood, that the zones of different contrast 17, 18 and 20 could be of lighter contrast than any of the striations 13-16, and that any of the zones 17, 18 and 20 can be of different contrast or combinations of contrast relative to each other, all within the spirit and scope of this invention. Some of the zones 17, 18 and 20 could be of lighter contrast while others could be of darker contrast. The zones 17, 18 and 20, or different ones of them could be in interrupting relation to any of, or all of, the striations as may be desired. Also, the zones 17, 18 and 20 could be of different widths from left to right, or of different heights, from top to bottom, as may be desired, or combinations thereof.

The zones 17, 18 and 20 are also referred to herein as being of "different" contrast that is "in interrupting contrast" to any of the varying zones or striations 13-16, for reasons that will be understood in the description, hereinafter.

It will also be understood that while in FIG. 1 there are shown four different striations 13-16, it will be understood that the front surface of the posterior or shim shingle layer 10 could be of a fewer or greater number of striations, as may be desired.

In FIG. 1A, the posterior layer of shingle material is designated by the numeral 110, having horizontal striations 113, 114, 115 and 116, each corresponding generally to the striations 13, 14, 15 and 16 of FIG. 1, but wherein the striations of FIG. 1A are separated by blend areas 119. The blend areas 119 comprise a blend of granules that make up each of striations 113, 114, 115 and 116, and such blend can either be a uniform mix of the granules that make up striations 113, 114, 115 and 116, or may comprise a non-uniform mix of the granules that comprise the striations 113, 114, 115, 116, or may even comprise a weighted average of the granules that make up striations 113, 114, 115 and 116, based upon any desired factor, such as the relative heights of the striations 113, 114, 115 and 116, as may be desired.

Referring now to FIG. 2, it will be seen that a multi-layer shingle 25 is provided, having the posterior layer 10 of FIG. 1 laminated by means of a suitable bitumen or other adhesive to the rear surface 26 of an anterior shingle layer 27, which shingle layer 27 has a front surface 28. The multi-layer shingle 25 has a headlap portion 30 and a tab portion 31. The headlap portion 30 is that portion of the shingle that is normally covered when in the installed condition on a roof by shingles in a next-overlying course of shingles, and the tab portion 31 of the shingle 25 is that portion of the shingle that is normally weather-exposed in the installed condition on a roof, overlying a headlap portion of a next-underlying course of shingles in the installed condition on a roof.

The arrows 24 above the FIG. 1 illustration illustrate how the posterior shingle layer 10 is applied beneath the anterior shingle layer 27 in FIG. 2.

The anterior shingle layer 27 has its tab portion 31 comprised of a plurality of tabs 32, 33 and 34, separated by intervening slots 35, 36, 37 and 38, with the right and left edges of the tabs 40, 41, respectively defining the edges of the slots, to present for the anterior shingle layer 27 a "dragons tooth" configuration, as shown.

In the embodiment shown for FIG. 2, the lower edges 42 of the tabs 32, 33 and 34 display a lower portion 43 of the posterior shingle layer 10 exposed therebeneath, in the form of a "petticoat" effect.

It will be seen that portions of the striations 13, 14, 15 and 16 of the posterior shingle layer 10 are visible through the openings between tabs of the anterior shingle layer 27 in the embodiment of FIG. 2.

It will also be seen that different contrast portions that are in interrupting contrast to the striations 13-16 in FIG. 2 are visible through the openings 36 and 37 in FIG. 2. It will be understood that these portions of different contrast that are in interrupting contrast to striations in FIG. 2 can be fewer, or greater in number, and can appear in only a single opening, in a plurality of openings, or in all of the openings between the tabs of FIG. 2.

With reference now to FIG. 2A, a fragmentary portion of a shingle 225 is shown, comprising an anterior shingle layer 227 and a posterior shingle layer 210, each of which are similar to a respective shingle layer 27 or 10, of FIGS. 2 and 3, but wherein, in the embodiment of FIG. 2A, the striations 213-216 (similar to the striations 13-16 of FIG. 2) are interrupted by a zone 220, also of "different" contrast that is in "interrupting contrast" to the zones 213-216, with the zone 220 of different contrast being such that its left-most edge as shown in FIG. 2A is at an oblique angle as shown. It will be understood that such angle may vary, as desired, and that the zone 220 can be at the right side of the striations as shown in FIG. 2A, as shown, or alternatively could be at the left side, or in any other disposition of interruption of the striations 213-216, all as may be desired.

With reference now to FIG. 2B, a portion of a modified shingle 325 is shown, having anterior and posterior shingle layers 327 and 310, likewise similar to the layers 27 and 10, respectively of FIGS. 2 and 3, and wherein striations 313-316 are illustrated, constructed in the same manner as the striations 13-16 of FIG. 2, which striations of FIG. 2B are interrupted by a zone 320, likewise of different contrast, and in "interrupting contrast" to striations 313-316, with the zone 320 being stepped or staggered, at the right edge, as shown. It will be understood that the zone 320 of FIG. 2B can be on either side of the opening between tabs, as may be desired, and can have its stepped or staggered portions of greater or narrower width, as shown, or constructed in any other manner as may be desired.

Each of the shingle layers 10 and 27 of FIGS. 1, 1A, 2, 2A, 2B and 3 are preferably constructed of a layer of mat, which is preferably a fiberglass mat, having bitumen such as asphalt applied thereto, and embedded therein, and with front surfaces of the shingle layers having granules applied thereto, and with rear surfaces of the layers 10 and 27 having smaller particles applied thereto, such as mica, sand, or other small particles, in accordance with conventional shingle manufacture. The top surface 28 of the shingle layer 27 is shown to have a plurality of dot-like marks thereon, indicating the presence of such granules.

It will be understood that the various striations 13-16, 113-116, 213-216 and 313-316 can be striations that vary in contrast in color, striations that vary in contrast in tones of the same general color, striations that vary in blends of colors and/or tones, as may be desired, to yield either particular sequences or a randomized number of sequences, as may be desired.

Referring now to FIG. 4, another multi-layer roofing shingle 50 is provided, comprised of an anterior shingle layer 51 and a posterior shingle layer 52, with the anterior shingle layer 51 being constructed as described above for the embodiment of FIG. 2, and with the posterior shingle layer 52 being constructed as described for the embodiment of FIGS. 1 and 2, except that in the embodiment of FIG. 4, the exposed portions 53-56 of the front surface of the posterior shingle layer are comprised of a vertically gradual variation in tone, color, or blends of colors or tones, rather than distinct striations. In FIG. 4, the opening through which the vertically gradual variation in tone 55 appears, there also appears a "different" contrast that is in interrupting contrast, as shown at 57, to the vertically gradual variation in tone 55, with the zone 57 being a lighter interrupting contrast.

In FIG. 5, a multi-layer roofing shingle 60 is illustrated, having an anterior shingle layer 61 and a posterior shingle layer 62, constructed similarly to the embodiment of FIG. 4, to have zones that are vertically of gradual variation in tone, from the front surface of the posterior shingle layer, visible through openings between tabs, but wherein there are darker zones 63 and 64 of interrupting contrast from the front surface of the posterior shingle layer, visible, in part, through openings 65 and 66, between tabs of the anterior shingle layer 61.

With reference now to FIG. 6, a multi-layer roofing shingle 70 is illustrated, comprised of an anterior shingle layer 71 and a posterior shingle layer 72, with the portions of the front surface of the posterior shingle layer that are visible through openings between tabs of the anterior shingle layer 71 being comprised of vertically gradual variations in tone, color, or combinations thereof, and with zones 73 and 74 that are darker in color appearing through openings 75, 76, as shown, and wherein the lower edge 77 of the posterior shingle layer extends beneath the lower ends 78 of tabs, in a "petticoat" effect.

Other than as described above for each of FIGS. 4-6, the individual shingle layers are constructed as described for the shingle layers of FIGS. 1 and 2, except for the vertical gradual variation in tone, color or combinations thereof for the front surfaces of the posterior shingle layer.

It will be apparent from the foregoing that various modifications may be made in the details of construction, as well as in the use and application of the shingles in accordance with this invention, all within the spirit and scope of the invention, and that the multi-layer roofing shingles may also be comprised of a greater number of layers than the two layers specifically described herein.

What is claimed is:

1. A two layer laminated roofing shingle comprising:

(a) an anterior shingle layer having a headlap portion and a tab portion, with the anterior shingle layer having front and rear surfaces;

(b) a posterior shingle layer having front and rear surfaces and top and bottom edges, with the front surface adhesively secured to the rear surface of the anterior shingle layer;

(c) with the tab portion of the anterior shingle layer having a plurality of tabs horizontally spaced apart and of vertical height to define a plurality of openings having right, left and top edges; with the openings being between the tabs, leaving portions of the front surface of the posterior shingle layer exposed through the openings between tabs of the anterior shingle layer;

(d) the front surface of the posterior shingle layer having the portions that are exposed through the openings between tabs of the anterior shingle layer (i) being of varying vertical contrast from at least some of the top edges of openings to at least some of the bottom edges of the posterior shingle layer that are exposed through the openings, and (ii) being of generally consistent horizontal contrast along the entire length of the posterior shingle layer; and (e) with the front surface of the posterior shingle layer that is exposed through at least one said opening between tabs having a different contrast than any of said varying or consistent contrasts of clause (d) and being in interrupting contrast to at least one of any of the varying or consistent contrasts of clause (d) in less than the entirety of any opening between right and left edges of adjacent tabs and present vertically throughout at least one said opening, whereby the different interrupting contrast leaves a portion of the varying or consistent contrast of clause (d) uninterrupted between right and left edges of adjacent tabs from top edges to bottom edges of the at least one said opening between adjacent tabs to the bottom edge of the posterior shingle layer.

2. The laminated roofing shingle of claim 1, wherein the varying contrast of exposed portion(s) of the front surface of the posterior shingle layer of clause (d) (i) comprises a plurality of generally horizontal striations.

3. The laminated roofing shingle of claim 2, wherein there are at least two said striations.

4. The laminated roofing shingle of claim 2, wherein there are at least three said striations.

5. The laminated roofing shingle of claim 2, wherein there are four said striations.

6. The laminated roofing shingle of claim 2, wherein the striations comprise varying contrasts in color.

7. The laminated roofing shingle of claim 2, wherein the striations comprise varying contrasts in tones of the same general color.

8. The laminated roofing shingle of claim 2, wherein the striations comprise varying contrasts in blends of colors and/or tones.

9. The laminated roofing shingle of claim 2, wherein the different contrast of clause (e) is in interrupting contrast to a plurality of generally horizontal striations of a given said opening.

10. The laminated roofing shingle of claim 2, wherein the different contrast of clause (e) is in interrupting contrast to a plurality of generally horizontal striations of a plurality of said openings.

11. The laminated roofing shingle of claim 2, wherein the different contrast of clause (e) is in interrupting contrast to at least one generally horizontal striation of a given said opening.

12. The laminated roofing shingle of claim 2, wherein the different contrast of clause (e) is in interrupting contrast to at least one generally horizontal striation of a plurality of said openings.

13. The laminated roofing shingle of claim 2, wherein the different striations are comprised of granules of different contrasts and wherein vertically adjacent ones of the generally horizontal striations are spaced apart by a blend of granules of each of the striations.

14. The laminated roofing shingle of claim 1, wherein the tabs are generally of dragon tooth configuration.

15. The laminated roofing shingle of claim 1, wherein the posterior shingle layer has a height from its bottom edge(s) to above the top edge(s) of the openings between tabs of the anterior shingle layer, but not substantially extending behind the headlap portion of the anterior shingle layer.

16. The laminated roofing shingle of claim 1, wherein the bottom edge of the posterior shingle layer extends below the bottom edges of the tabs of the anterior shingle layer.

17. The laminated roofing shingle of claim 1, wherein the varying contrast of exposed portion of the front surface of the posterior shingle layer of clause (d) comprises a vertically gradual variation in tone.

18. The laminated roofing shingle of any one of claim 17, wherein the front surface of the anterior shingle layer has a contrast with at least some of the surface portions of the posterior shingle layer that are exposed through the openings between tabs.

19. The laminated roofing shingle of claim 17, wherein the different contrast of clause (e) of claim 1 is in a plurality of said openings.

20. The laminated roofing shingle of any one of claim 1, wherein the front surface of the anterior shingle layer has a contrast with at least some of the surface portions of the posterior shingle layer that are exposed through the openings between tabs.

21. The laminated roofing shingle of claim 1, wherein the different contrast of clause (e) is a darker contrast.

22. The laminated roofing shingle of claim 1, wherein the different contrast of clause (e) is a lighter contrast.

23. The laminated roofing shingle of claim 1, wherein the different contrast that is in interrupting contrast has an obliquely sloped edge.

24. The laminated roofing shingle of claim 1, wherein the different contrast that is in interrupting contrast has a staggered edge.

25. The laminated roofing shingle of claim 1, wherein the different contrast interrupts all of the varying or consistent contrasts of at least one said opening.

* * * * *